US005241791A

United States Patent [19]

Lacy

[11] Patent Number: 5,241,791

[45] Date of Patent: Sep. 7, 1993

[54] EDGE TOOL SHARPENING APPARATUS

[75] Inventor: Graham K. Lacy, Kettering, England

[73] Assignee: Alfred Brian Gardner, London, England

[21] Appl. No.: 925,033

[22] Filed: Aug. 5, 1992

[30] Foreign Application Priority Data

Mar. 4, 1992 [GB] United Kingdom ..... 9204650

[51] Int. Cl.[5] ..... B24B 7/00

[52] U.S. Cl. ..... 51/81 R; 51/81 BS; 51/111 R; 51/218 R; 51/219 R

[58] Field of Search ..... 51/72 R, 80 R, 80 BS, 51/81 R, 81 BS, 111 R, 218 R, 218 A, 219 R, 219 AC

[56] References Cited

U.S. PATENT DOCUMENTS

| | | | |
|---|---|---|---|
| 1,873,612 | 8/1932 | Martell | 51/219 R |
| 2,080,515 | 2/1934 | Tautz . | |
| 2,133,414 | 1/1937 | Bahuaud . | |
| 2,207,804 | 10/1938 | Hoagland . | |
| 3,081,585 | 5/1961 | Boggis . | |
| 3,102,370 | 9/1963 | Ribich | 51/219 R |
| 3,169,353 | 2/1965 | Krulwich | 51/219 R |
| 4,471,581 | 9/1984 | Bernard et al. . | |
| 4,744,178 | 5/1988 | Afshar | 51/219 R |

FOREIGN PATENT DOCUMENTS

| | | | |
|---|---|---|---|
| 1020755 | 11/1977 | Canada | 51/219 R |
| 0084855 | 1/1983 | European Pat. Off. . | |
| 0374734 | 12/1989 | European Pat. Off. . | |
| 239296 | 10/1925 | United Kingdom . | |
| 306887 | 7/1929 | United Kingdom . | |
| 431046 | 7/1935 | United Kingdom . | |
| 639043 | 6/1950 | United Kingdom . | |
| 1080502 | 8/1967 | United Kingdom . | |
| 1233524 | 5/1971 | United Kingdom . | |
| 1468327 | 3/1977 | United Kingdom . | |
| 1526169 | 9/1978 | United Kingdom . | |
| 2078574 | 1/1982 | United Kingdom . | |
| 2186512 | 8/1987 | United Kingdom . | |

*Primary Examiner*—M. Rachuba

*Attorney, Agent, or Firm*—Jacobson, Price, Holman & Stern

[57] ABSTRACT

Edge tool sharpening apparatus for the sharpening of an edge tool having a shank (e.g. a wood drill bit), the apparatus including an axially rotatable abrasive element having a peripheral abrasive surface; and a support device having support surfaces to support the shank of the tool such that its face to be sharpened engages the abrasive surface with the shank axis at an acute angle to the diametral plane of the rotatable abrasive element through the engagement location, the support device providing for automatic compensation for different shank diameters of different drill bits, when supported by the support surfaces, by automatically effecting an increase in the inclination of the diametral plane with increase in the diameter of the shank and such that the acute angle is substantially constant for a range of drill bit shank sizes. Advantageously, for sharpening a wood drill bit, the support device is positioned such that a wood drill bit supported thereby can engage the abrasive element with a main clearance face of the wood drill bit in sharpening engagement of the element's peripheral surface, the diametral plane of the abrasive element through the engagement location being inclined to the drill bit's shank axis at substantially the clearance angle of the clearance face, and simultaneously also with a preliminary indenting face of the central nib of the wood drill bit in sharpening engagement of the element's lateral surface.

16 Claims, 7 Drawing Sheets

Figure 2:
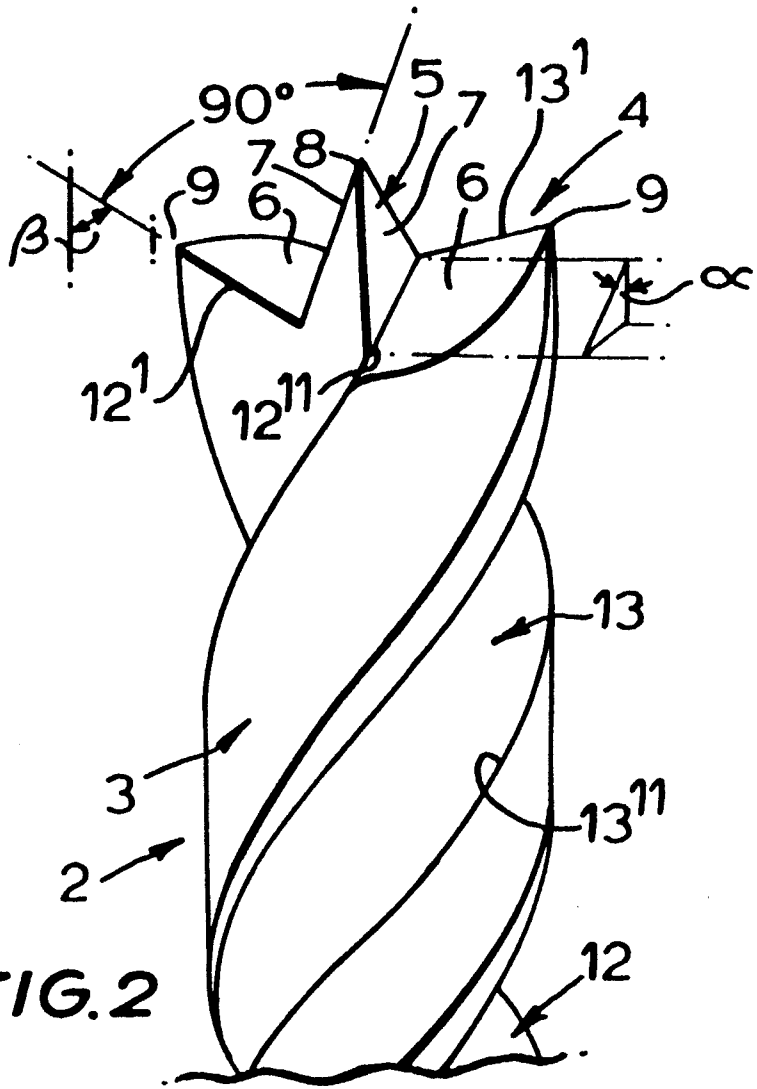

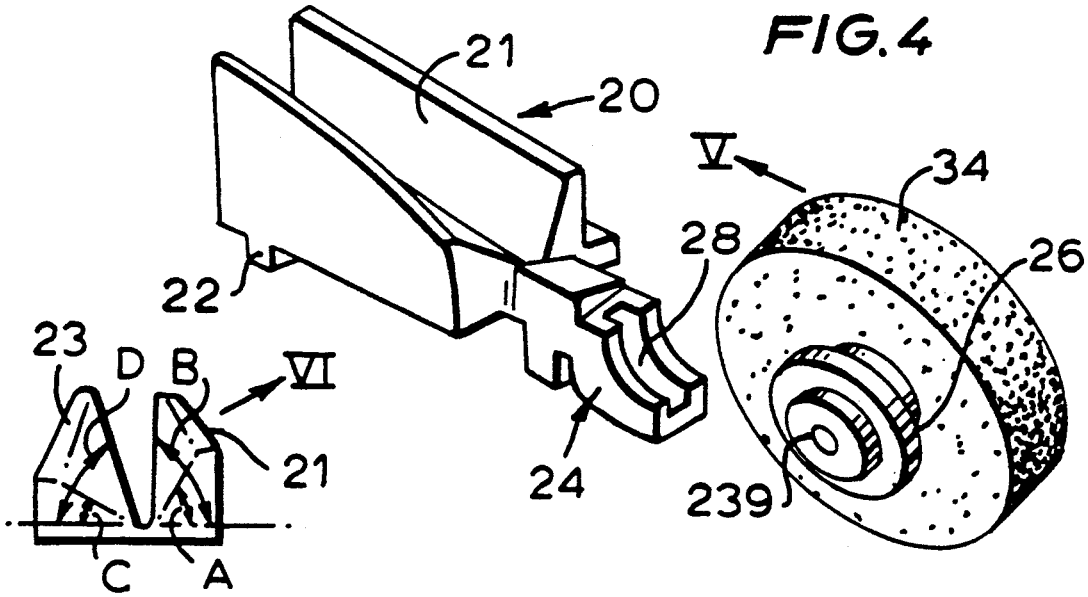
FIG. 4
FIG. 5
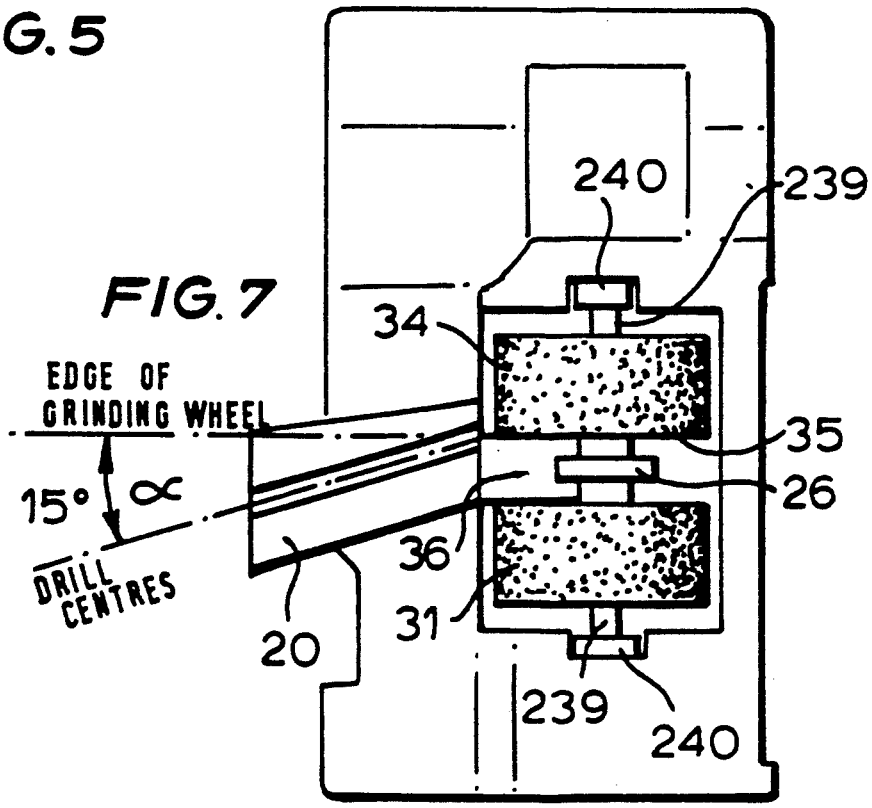
FIG. 7

EDGE TOOL SHARPENING APPARATUS

This invention relates to sharpening, and in particular to sharpening of drill bits.

Several kinds of drill bits are known for use in drilling into different materials, e.g. wood, high speed steel, masonry, glass, ceramics, concrete et al. Although high-speed steel (HSS) drill bits can be readily used for drilling into wood, better and more accurate results are obtained with so-called "centre-point" or "bradawl-point" drill bits. Such drill bits will be herein referred to as "wood drill bits" which expression, as used herein, refers to a drill bit comprising a generally cylindrical shank, the cutting end of the drill bit being formed with a forwardly directed central nib or spike-like projection of generally triangular or pyramidal shape, and with a pair of main cutting edges at the forward ends of clearance faces oppositely inclined at a predetermined clearance angle (herein sometimes referred to as "relief angle") to the radial plane perpendicular to the shank axis, the two clearance faces being disposed one to each side of the central nib and, in extending from the opposite sides of the drill towards the drill axis, are inclined to the respectively adjacent, axially inclined, side face of the central nib at a predetermined "nib face to clearance face" angle.

Preferably (but not necessarily) said predetermined "nib face to clearance face" angle is 90°.

Preferably (but not necessarily) the two said clearance faces are raked backwards at a predetermined rake angle to the opposite sides of the drill bit.

Preferably (but not necessarily) the wood drill bit is arranged such that the tip of the central nib projects forwardly of the radial plane through the most forward extremities of the main clearance faces. The axially inclined side faces of the generally triangular or pyramidshaped central nib can then be arranged to provide preliminary clearance faces for the wood drill bit.

Wood drill bits having the above general characteristics — with or without one or more of the optional preferred features — may be of two kinds.

One, called a "flat-bottomed" or "spade" wood drill bit, provides the cutting end of the drill bit as a flat plate-like portion extending in a diametral plane from the shank and terminating in a pair of transversely directed, substantially planar, main clearance faces that are of generally narrow recatngular shape, the narrow width dimension of which being determined by the thickness of the plate-like portion.

The other kind of wood drill bit, herein called a "cylindrical wood drill bit", has a pair of diametrically opposite helical flutes in the shank's generally cylindrical surface, the flutes extending to the cutting end of the drill bit and such that each main clearance face extends between the leading edge of one flute and the trailing edge of the diametrically opposite flute.

It will be appreciated that, with the cylindrical wood drill bit, the arris between each main clearance face and its associated, flute leading edge provides a main cutting edge of this wood drill bit.

Sharpening apparatus for drill bits in general is known inter alia from EP-A2-0374734, EP-A2-0084855, GB-1233524, GB-239296, GB-431046, GB-306887, GB-1526169, GB-1080502, GB-639043, GB-1468327, GB-2078574, GB-21865212, U.S. Pat. No. 4,471,581, U.S. Pat. No. 3,081,585, U.S. Pat. No. 2,207,804, U.S. Pat. No. 2,133,414, U.S. Pat. No. 2,080,515.

U.S. Pat. No. 2,080,515 provides for sharpening of spade-like "flat-bottomed" drill bits by two separate sharpening operations, one for the main cutting edges and one for the preliminary cutting edges of the tip. In addition it requires a complex chucked mounting for the drill bit, which provides no positional adjustment, relative to its grinding wheel, for wood drill bits of different shank diameters.

Support members for high-speed steel (HSS) drill bits are known and, as proposed in GB-1468327 and GB-1526169, can comprise a very simple V-shaped block of uniform cross-section. Such simple V-shaped blocks are considered quite inappropriate in apparatus for sharpening wood drill bits due to the need for different sizes of such drill bits, with different shank diameters, to have their main cutting edges and their preliminary cutting edges sharpened with the same clearance angle — irrespective of size.

According to one aspect of the present invention there is provided apparatus for sharpening a wood drill bit, said apparatus comprising: an axially rotatable abrasive element having a peripheral abrasive surface and a radial abrasive surface, support means for a wood drill bit, and means for positioning the support means such that a wood drill bit supported thereby can engage the abrasive element with (a) a said main clearance face in sharpening engagement of the element's peripheral surface, the diametral plane of the abrasive element through the engagement location being inclined to the drill bit's shank axis at substantially the clearance angle of the clearance face, and simultaneously also with (b) a said preliminary indenting face of the central nib in sharpening engagement of the element's radial surface.

Although this will provide a somewhat hollow-ground finish to the main clearance face, for most practical purposes this is not generally considered a disadvantage.

Preferably the said peripheral surface is a cylindrical surface at right-angles to the radial surface to suit the apparatus for sharpening wood drill bits having a predetermined "nib face to clearance face" angle of 90°. Alternatively, the abrasive element may have a frusto-conical peripheral surface at an angle to the said radial surface equal to a predetermined "nib face to clearance face" angle other than (e.g. more than) 90°.

Preferably the support means provides for the angle of inclination of said diametral plane to a datum plane containing the element's rotational axis to be increased with increase in diameter of the drill bit's shank and such that the said clearance angle is maintained substantially constant for a range of drill bit shank sizes.

According to another aspect of the present invention there is provided edge tool sharpening apparatus for the sharpening of an edge tool comprising a shank (e.g. a wood drill bit), said apparatus comprising:

an axially rotatable abrasive element having a peripheral abrasive surface, and support means to support the shank of the tool such that its face to be sharpened engages the abrasive surface with the shank axis at an acute angle to the diametral plane of the rotatable abrasive element through the engagement location, characterised in that said support means provides for automatic increase in the inclination of said diametral plane with increase in the diameter of the shank and such that said acute angle is substantially constant for a range of drill bit shank sizes.

Advantageously said angle is substantially the clearance angle of the said face, e.g. 15°.

Preferably, with either said aspect of the invention the support means provides first and second pairs of inclined support zones spaced apart to support a shank at at least two longitudinally spaced locations.

Advantageously the pair of inclined support zones adjacent the abrasive element are mutually inclined at a first angle, and the pair of inclined support zones distal from the abrasive element are mutually inclined at a second angle, smaller than the said first angle.

Preferably the inclined support zones are provided by the surfaces of a generally V-shaped channel. Preferably the channel surfaces are flat (or planar), e.g. skewed to one another. Alternatively the channel surfaces may be of arcuate cross-section (to provide a somewhat cusp-shaped recess to accomodate the shank of a wood drill bit).

Advantageously the said positioning means comprises means to connect the support means to a part that is substantially immovable axially of the rotatable abrasive element, i.e. is substantially axially fast therewith.

Preferably said positioning means is formed integrally, e.g. as a plastics material moulding, with said support means.

In a preferred embodiment, the said part comprises a flanged ferrule (e.g. trapped between a pair of abrasive wheels — one of which is to serve as said abrasive element) and said positioning means comprises a (preferably curved) finger having an arcuate internal groove into which, in use, the flange of the ferrule is to sit and be rotatable therein.

Advantageously the pair of abrasive wheels may form part of sharpening apparatus according to UK Pat. No. 2186512, the support means being mounted removably on the platform thereof.

Figure 1:
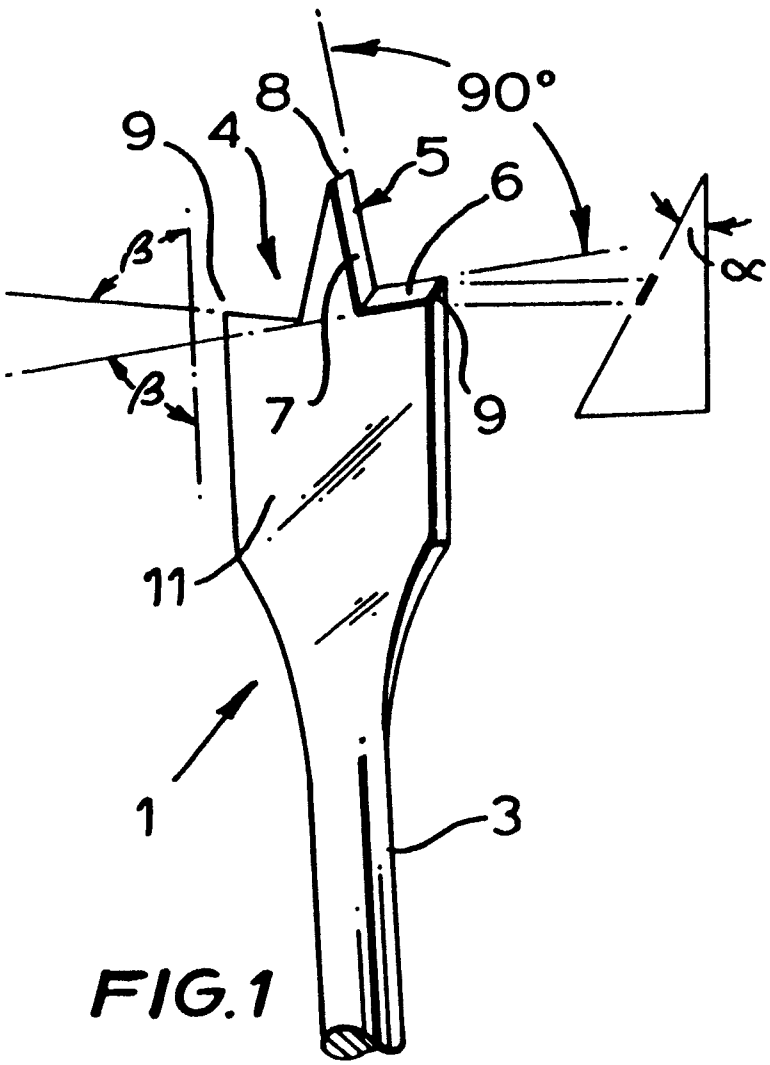
Figure 3:
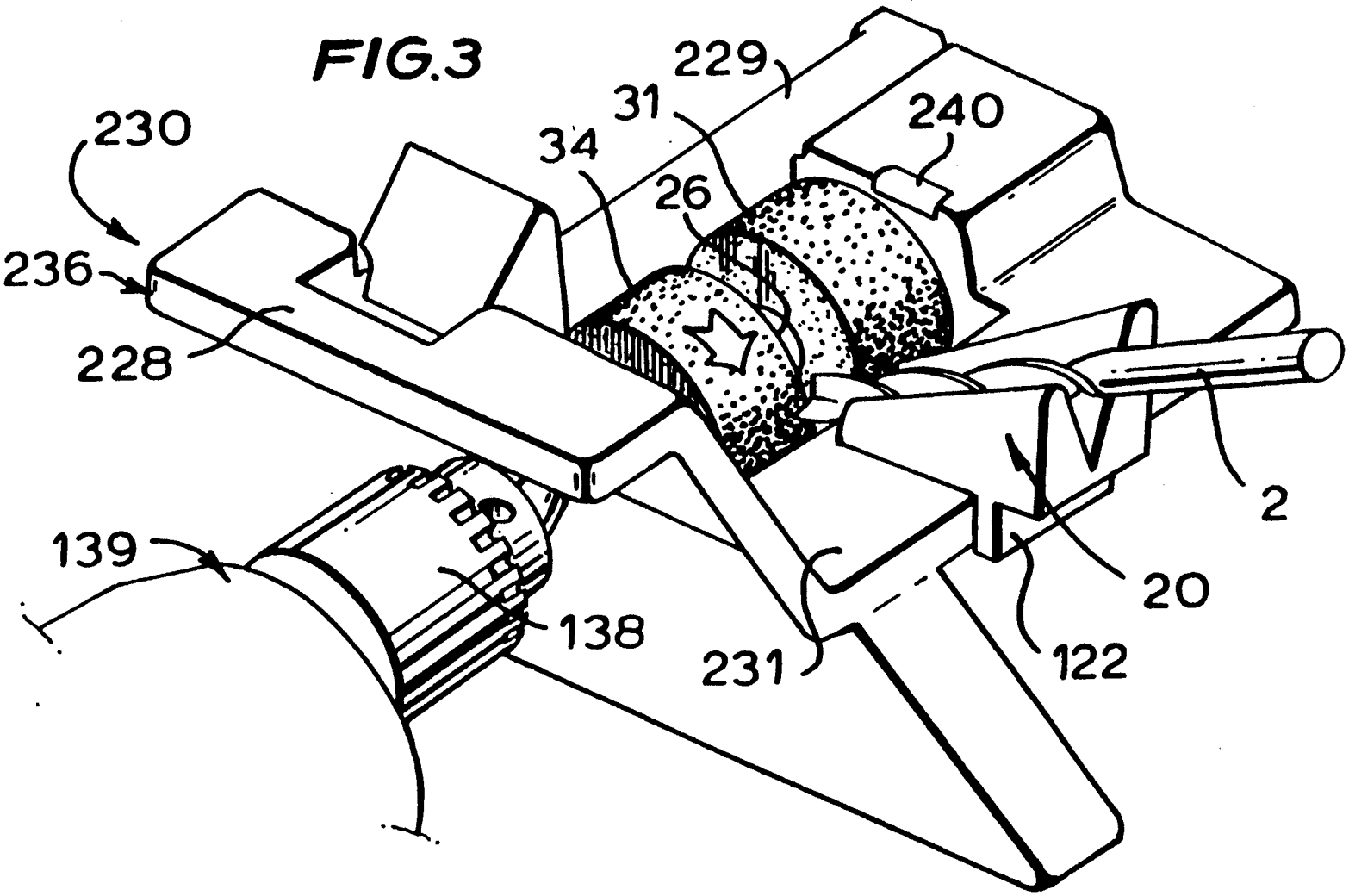
Figure 3A:
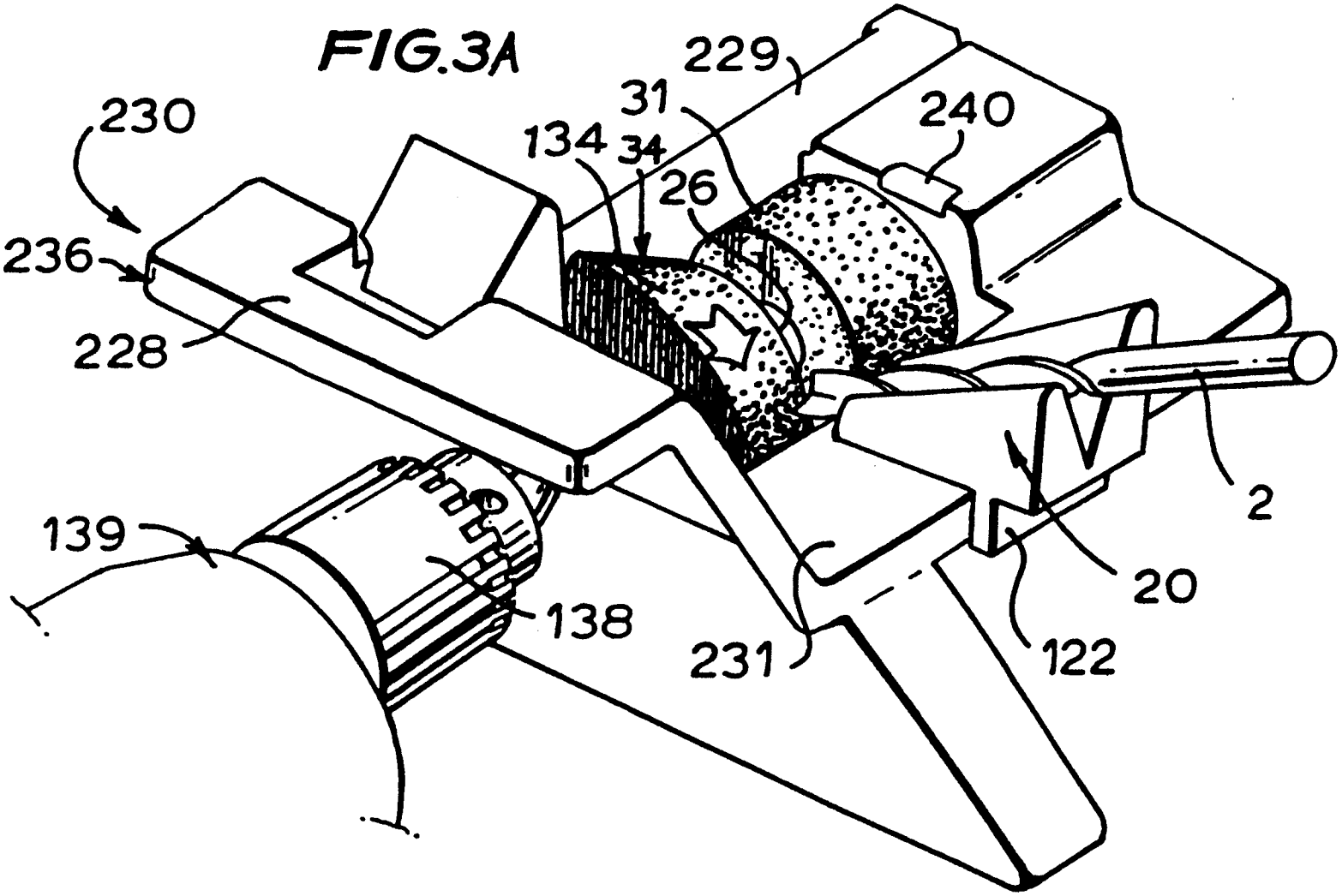
Figure 6:
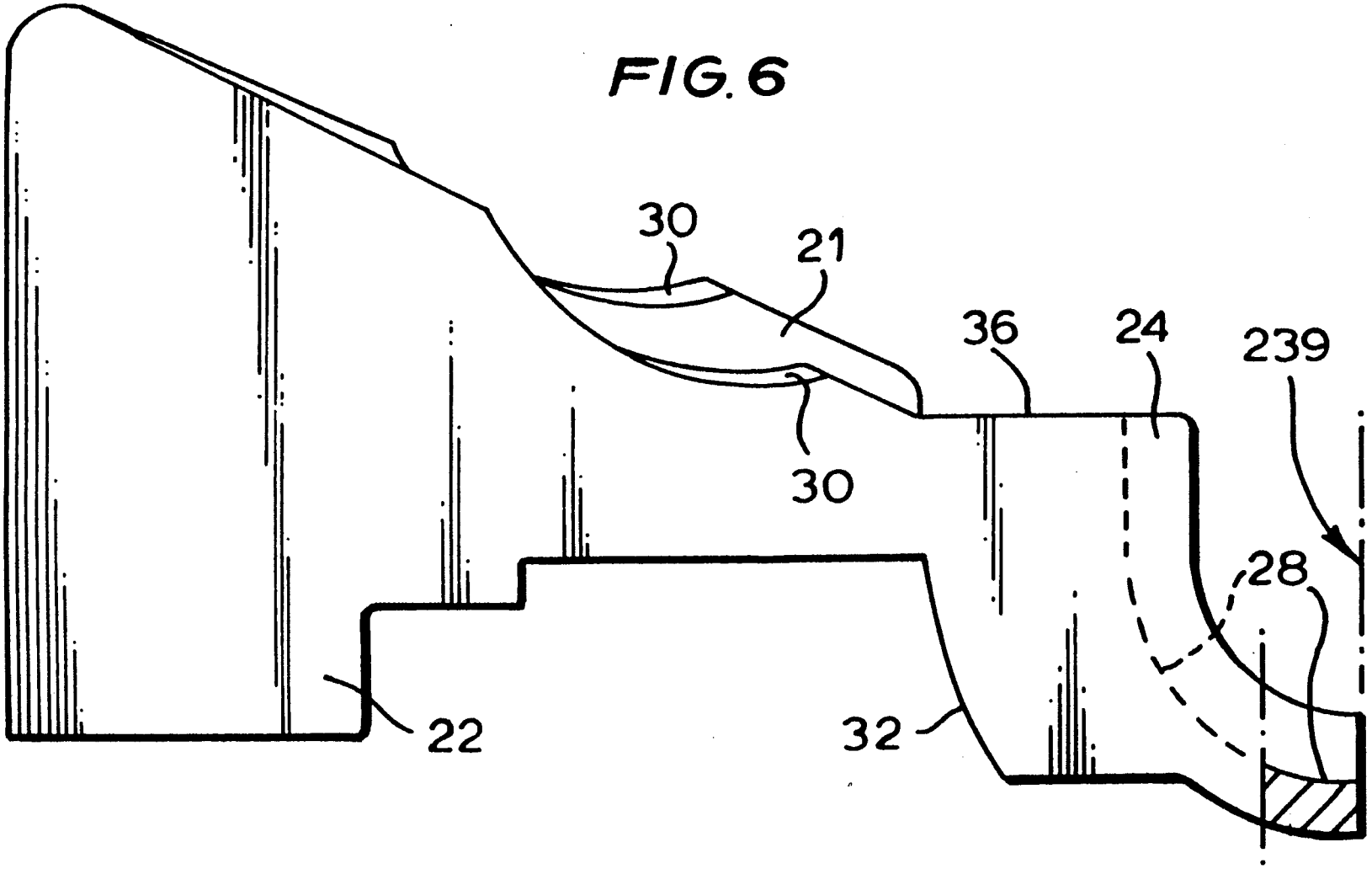
Figure 8:
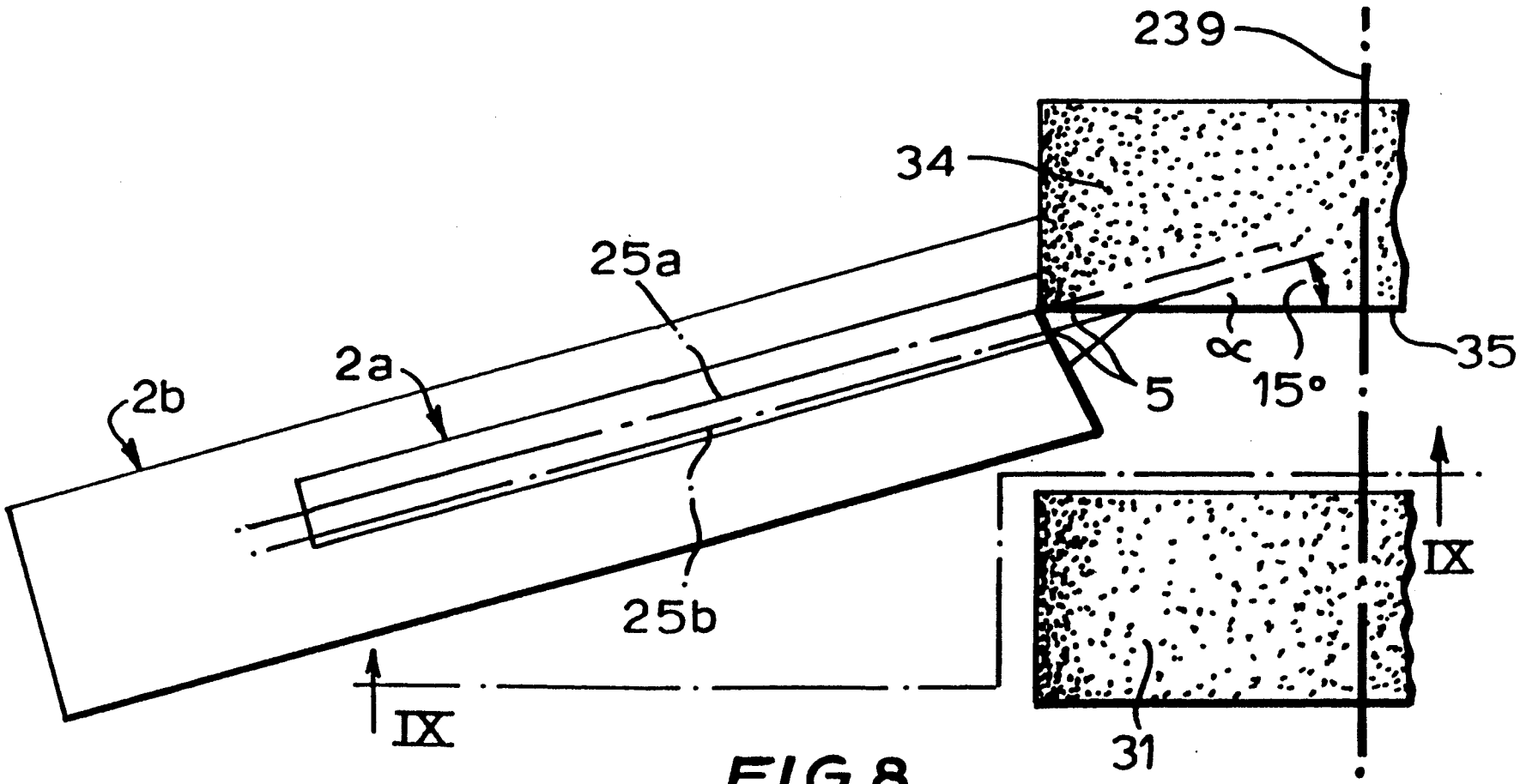
Figure 9:
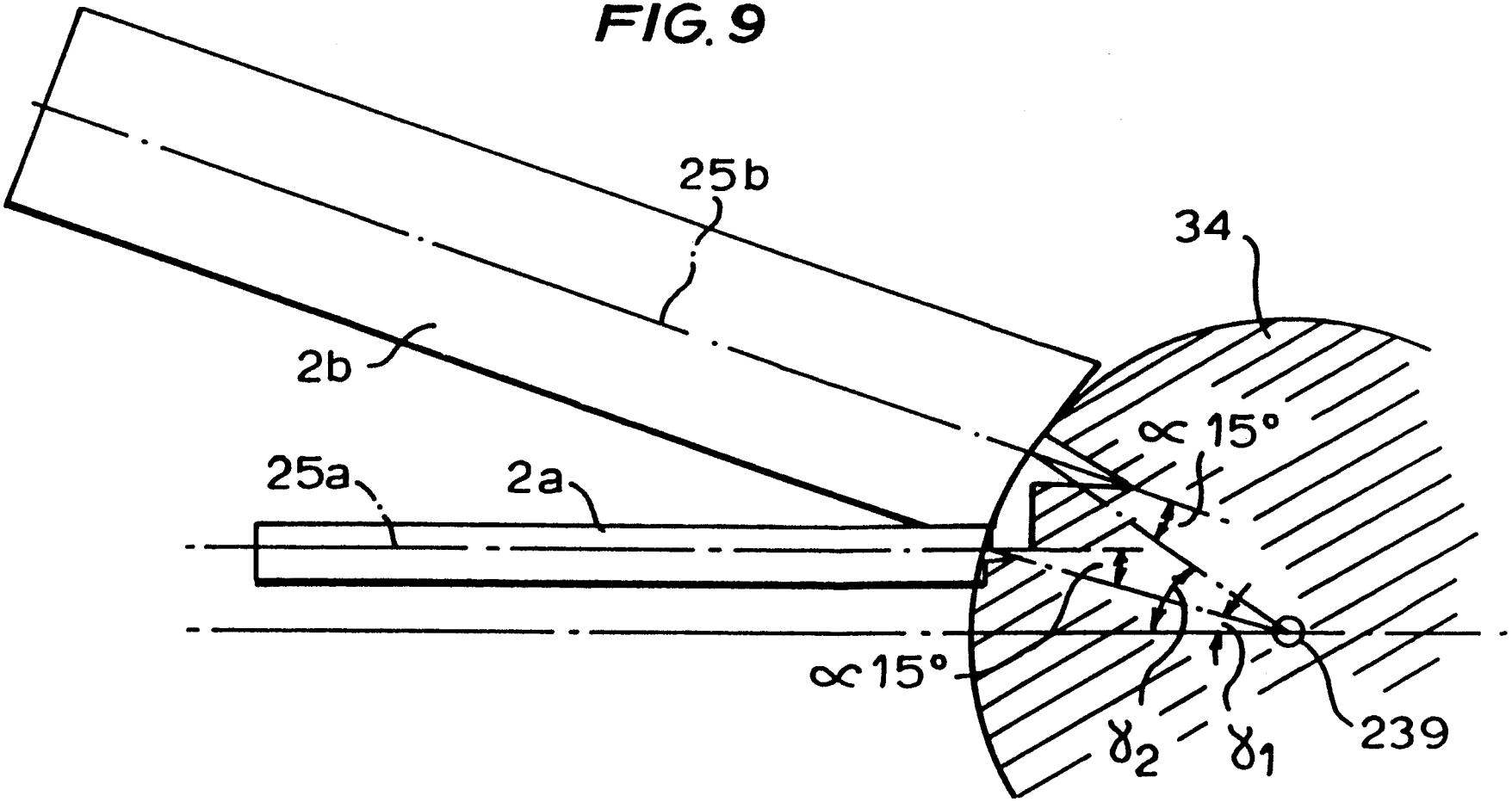

By way of example one embodiment of this invention will now be described with reference to the accompanying drawings of which:

FIG. 1 is a schematic perpspective view of the cutting end of a flat-bottomed or spade-like wood drill bit, FIG. 2 is a schematic perspective view of the cutting end of a cylindrical wood drill bit, FIG. 3 is is a schematic perspective view of apparatus embodying this invention in use for sharpening a cylindrical wood drill bit such as that of FIG. 2, FIG. 3A is a similar view to FIG. 3 and illustrating a modification thereof, FIG. 4 is a schematic perspective exploded view of parts of the apparatus of FIG. 3, FIG. 5 is a schematic view in the direction of arrow V of FIG. 4, FIG. 6 is a side view in the direction of arrow VI of FIG. 4 showing a modified form of the apparatus, FIG. 7 is a schematic plan view of the apparatus of FIG. 3 (with the wood drill bit omitted), FIG. 8 is a diagrammatic plan view on an enlarged scale of elements illustrated in FIG. 7, and FIG. 9 is a diagrammatic side elevation of elements illustrated in FIG. 7 taken on the line IX—IX of FIG. 8.

The flat-bottomed or spade-like wood drill bit 1 of FIG. 1 and the cylindrical wood drill bit 2 of FIG. 2 each comprise a generally cylindrical shank 3, the cutting end 4 of the drill bit being formed with a forwardly directed central nib or spike-like projection 5 of generally triangular or pyramidal shape, and with a pair of main clearance faces 6. Each of the wood drill bits 1 (FIG. 1) and 2 (FIG. 2) has its clearance faces 6 disposed one to each side of the central nib 5, oppositely inclined at a predetermined clearance angle $\alpha$ to the radial plane perpendicular to the shank axis and, in extending from the opposite sides of the drill towards the drill axis, raked backwards at a predetermined rake angle $\beta$ to the opposite sides of the drill bit such as to be each at an angle of 90° to the respectively adjacent, axially inclined, side face 7 of the central nib.

Each of the "spade" and the "cylindrical" wood drill bits 1 and 2 has the tip 8 of its central nib 5 projecting forwardly of the radial plane through the most forward extremities 9 of the main clearance faces. The axially inclined side faces 7 of the generally triangular or pyramid-shaped central nib 5 provide preliminary indenting faces for the wood drill bit (for initially guiding the wood drill bit into the workpiece), these preliminary indenting faces 7 having potentially a substantially similar clearance angle $\alpha$.

The "flat-bottomed" or "spade" wood drill bit 1 of FIG. 1 has its cutting end provided as a flat plate-like portion 11 extending in a diametral plane from the shank 3 and providing the pair of main clearance faces 6 as transversely directed, substantially planar faces of generally narrow rectangular shape, the narrow width dimension of which being determined by the thickness of the plate-like portion 11.

It will be appreciated that, with the flat-bottomed wood drill bit 1, the most forward edge of each main clearance face 6 provides a main cutting edge of this wood drill bit.

The "cylindrical" wood drill bit 2 of FIG. 2 has a pair of diametrically opposite helical flutes 12,13 in the shank's generally cylindrical surface, the flutes extending to the cutting end of the drill bit and such that each main clearance face 6 extends between the leading edge 12',13' of one flute and the trailing edge 12'',13'' of the diametrically opposite flute.

It will be appreciated that, with the cylindrical wood drill bit 2, the arris between each main clearance face 6 and its associated, flute leading edge 12',13' provides a main cutting edge of this wood drill bit.

FIG. 3 illustrates a stepped base structure 236 forming part of sharpening/grinding apparatus 230 according to UK Pat. No. GB-B-2186512. This stepped base structure 236 is molded of glass-filled nylon and serves to mount two co-axial grinding wheels 31,34 of differing abrasive properties, for use primarily in sharpening respectively masonry and HSS drill bits. To this end the sharpening/grinding apparatus 230 of GB-B-2186512 additionally includes: a bridge member (not now shown) removably mounted on the stepped base structure 236 for slidable assocation with one or other of the grinding wheels 31,34; a carrier (not now shown) provided with a pair of trunnion arms by which the carrier is to be mounted on the bridge member; and a drill bit holder (also not now shown) for holding either a masonry drill bit or a twist drill bit to be sharpened, and for insertion into the carrier such that the HSS or masonry drill bit faces to be sharpened can selectively engage one or other of the grinding wheels 31,34.

The stepped base structure 236 of FIG. 3 has an upper level 229 (located rearwardly when the apparatus is in use) and a lower level 231 (located forwardly when the apparatus is in use). The upstanding region connecting the levels 229 and 231, and adjoining portions of these levels, are apertured to reveal a substantial angular extent (e.g. approximately 135°) of each of the two grinding wheels 31,34. The common shaft or spindle 239 upon which these wheels 31,34 are mounted, is journalled in nylon bearings 240 and projects laterally outwards of the structure 236 below a raised shield plate 228 that is formed integrally with the upper and lower levels 229,231 of the base structure 236. The shield plate 228 protects the user of the sharpening/grinding apparatus 230 against injury from the rotating chuck of the electric drill 139 or other power tool in which the spindle or shaft 239 of grinding wheels 31,34 is in use engaged, the power tool resting on its side on the work bench or table upon which the base structure 236 is located. Alternatively, the spindle 239 may be belt driven from a remote motor or engine.

To convert the HSS and masonry drill bit sharpening-grinding apparatus 230 of UK Pat. No. GB-B-2186512 to apparatus suitable for sharpening wood drill bits, the bridge member that normally overlies the wheels 31,34 is removed from off the base structure 236, and the optional fitting illustrated in FIG. 3 (and in FIGS. 4 to 7) is attached to the base structure 236. This sharpening attachment illustrated in FIG. 3 (and in FIGS. 4 to 7) is primarily intended for sharpening 'cylindrical' wood drill bits 2 (of FIG. 2), but it is considered that it may be readily modified dimensionally to suit it for sharpening 'flat-bottomed' wood drill bits 1 (of FIG. 1) either in addition or in the alternative.

The fitting illustrated in FIG. 3 (and in FIGS. 4 to 7) comprises a generally V-shaped block 20 to provide support means for a wood drill bit to be sharpened. The block 20 is molded of plastics material (e.g. glass-filled nylon) integrally with forward and rearward pegs 22,32 of generally rectangular-section that depend from beneath the block 20 to abut against respectively the front edge of the stepped base structure 236 and the rearward edge of the base structure's lower level 231, i.e. the forward edge of the aperture through which grinding wheels 31,34 project, at a location opposite the peg 22. The block 20 is also molded integrally with a grooved arcuate extension 24 that is to project inbetween the two grinding wheels 31,34 beneath their common shaft or spindle 239 and such that its arcuate groove 18 receives fittingly therein a flanged spacer disc 26 (FIG. 4) located between the two wheels 31,34 and secured to their said common axle or shaft 239 so as to be axially fast therewith.

In an alternate arrangement, one or both of the edge-engaging pegs 22,32 may be replaced by one or more pegs engaging in elongate holes or guide channels provided in the base structure 236.

The generally V-shaped block 20 has its two surfaces 21,23 skewed to one another so that the V-angle changes along the block's length. The plane bisecting the V of the block throughout its length is inclined to the vertical. The inclination to the horizontal plane of skew surface 21, measured in planes perpendicular to the plane bisecting the V, varies along the length of the V-block 20 from an angle A adjacent the end of skew surface 21 nearest the wheel 34, to an an angle B adjacent the end of skew surface 21 remote from wheel 34 (see FIG. 5). Similarly the inclination to the horizontal plane of skew surface 23, measured in planes perpendicular to the plane bisecting the V, varies along the length of the V-block 20 from an angle C adjacent the end of skew surface 23 nearest the wheel 34, to an an angle D adjacent the end of skew surface 23 remote from wheel 34. In one particularly preferred example, the angle A is equal to approximately 56° at a point in the bisecting plane of the V-block 22.6 mm from the wheel axis in a direction perpendicular thereto, and the angle B is equal to approximately 80° at a distance of 36.0 mm from that point along the bisecting plane of the V-block. In the same example, the angle C is equal to approximately 34° at a point in the bisecting plane of the V-block 22.6 mm from the wheel axis in a direction perpendicular thereto, and the angle D is equal to approximately 73° at a distance of 40.0 mm from that point along the bisecting plane of the V-block.

Thus, in this preferred example, the included angle between the two skew planes 21 and 23, measured in planes perpendicular to the plane bisecting the V, may vary from approximately 90° adjacent wheel 34 to approximately 28° remote from wheel 34. Accordingly the central axis of cylindrical shanks (of wood drill bits) of differing diameters placed in the V-block 20 are located at positions that differ both horizontally and vertically, depending on the said shank diameter. A cylindrical wood drill bit **2*b* (FIG. 9) having a large diameter shank inserted into the V-block 20 will be inclined (in a vertical plane) at a greater angle $\gamma_2$, i.e. will have its front cutting end raised far less than its remote "drill chuck" end, as compared with a cylindrical wood drill bit 2*a* having a smaller diameter shank which will lie in the V-block 20 at an inclined angle of $\gamma_1$ to the horizontal (see FIG. 9**).

Nevertheless, as shown in FIG. 9, the change in position and inclination of the shank (in the vertical plane containing its axis) is such that the clearance face 6 of the cylindrical wood drill bit that is to be sharpened engages the abrasive cylindrical surface of the wheel 34 with the shank axis at an acute angle $\alpha$ to the diametral plane of the rotatable abrasive element through the engagement location, and that the inclination ($\gamma_1$,$\gamma_2$) of this diametral plane to the horizontal plane through the wheel axis is automatically increased with increase in the diameter of the shank and such that said acute angle $\alpha$ is substantially constant — i.e. is substantially the same clearance angle $\alpha$ (e.g. equal to 15°) — for a range of drill bit shank sizes (e.g. from 3 mm to 13 mm diameter).

Additionally, as shown diagrammatically in the schematic plan views of FIGS. 7 and 8, the bisecting plane between the skew faces 21,23 of the V-block 20 meets the radial face 35 of the wheel 34 (i.e. the face thereof adjacent to wheel 31) at a location adjacent to, but spaced from, the cylindrical peripheral surface of the the wheel 34. Due to the 'canting over' of the bisecting plane of the V, this spacing (of the axis' intersection with wheel face 35) from the arris between the two wheel surfaces varies in accord with the diameter of the shank such that, whatever the diameter of the shank (within a suitable range for which the arrangement is designed — e.g. shank diameters from 3 mm to 13 mm), the shank axis **25*a* of a small shank diameter cylindrical wood bit 2*a* and the shank axis 25*b* of a large diameter cylindrical wood bit 2*b* will each be similarly inclined at an acute angle to the radial face 35 equal to the drill bit's clearance angle $\alpha$ (e.g. 15°). Additionally, in this attitude and irrespective of whether the shank diameter is large or small, the drill bit's cutting end can engage the abrasive wheel 34 with its main clearance face 6** in sharpening engagement of the wheel's cylindrical surface (the diametral plane through the engagement location being inclined to the drill bit's shank axis at substantially the clearance angle $\alpha$ of the clearance face, as already explained) and simultaneously also with the drill bit's preliminary indenting face 7 — provided by the sloping side of the drill's central nib 5 — in sharpening engagement of the wheel's radial surface 35 at the same clearance angle $\alpha$ (e.g. of 15°).

Due to the 90° angle between the wheel's radial surface 35 and the wheel's cylindrical periphery, the sharpening operation maintains the 90° angle between the main cutting edge 6 and the respectively adjacent, axially inclined, side face 7 of the central nib 5, whilst also ensuring that both these faces 6 and 7 are ground at the same clearance angle $\alpha$ (e.g of 15°).

It will thus be apparent that due to the variation, with V-block length, in the included angle between the two skew surfaces 21 and 23, as well as the "rotation" or 'canting over' of the V-block's bisecting plane, the different diameter cylindrical shanks of wood drill bits placed into the V-block 20

(a) adopt different positions and different angles in the vertical planes containing each shank axis according to, and automatically catering for, the shank diameter (i.e. the drill size), and at the same time (b) adopt different positions, but at the same angular attitude, in the horizontal planes containing each shank axis according to, and automatically catering for, the shank diameter (i.e. the drill size).

The above-described variable geometry of the V-block 20 thus provides, on the one hand, a horizontal positional difference for differently sized drills to control the size of the bradawl point (i.e. the nib 5) of the drill, moving this point further away from the grinding wheel corner (between its cylindrical surface and radial face 35) with increasing drill size.

Also, because angle of the 'V' nearest the wheel 34 is greater than remote from the wheel, different sizes of drill bit shanks resting in the 'V' of the block 20 have their cutting ends at different heights, and have their shank axes resting at different inclinations $\gamma$ to the horizontal plane containing the wheel axis, the inclination $\gamma$ increasing with increase in drill size but yet providing for each size of drill bit to meet the cylindrical surface of the grinding wheel 34 with the drill bit axis at the same acute angle — substantially equal to the clearance angle $\alpha$ — to the diametral plane of the wheel through the drill bit's wheel-engagement location. Thus the abovedescribed variable geometry of the V-block 20 also provides, on the other hand, a vertical positional difference for differently sized drills such as automatically to maintain the grinding of the main clearance face 6 at the same clearance angle $\alpha$ for all sizes of the cylindrical wood bit (within the range of sizes for which the arrangement is designed).

Optionally, as shown in FIG. 6, the upper surface of the V-block 20 (from which the skewed surfaces 21,23 descend) may be provided with indents 30 for a user's fingers thereby to facilitate manual holding in the 'V' the wood drill bit that is to be sharpened.

To aid in holding the wood drill bit steady against rotation whilst the cutting faces 6 and preliminary indenting faces 7 are being simultaneously ground, the block 20 may be provided with an integral abutment surface 36 between the 'V' and the grooved extension 24, this surface 36 being inclined to the horizontal and being in use engaged by the cutting edge (or at least the outer corner thereof) of the main clearance face 6 opposite to that being sharpened or ground by the cylindrical periphery of the wheel 34. Such abutting engagement resists accidental rotation of the cylindrical wood drill bit whilst it is being sharpened.

It will be appreciated that after sharpening simultaneously one main clearance face 6 and its adjacent preliminary (or secondary) indenting face 7 of the nib 5, the wood drill bit is inverted — i.e. rotated about its longitudinal axis by 180° — and the sharpening operation repeated with the other main clearance face 6 and its there-adjacent preliminary (or secondary) indenting face 7 of the nib 5.

It will be noted that the generally arcuate groove or channel 24, located around the flange of the spacer disc 26, enables the block 20 to slide along the structure 236 together with any axial 'floating' movement of the shaft 239 — and the wheels 31,34 and disc 26 longitudinally fast therewith — relative to the bearings 240. This assists in providing that the drill bit is maintained in the correct position with respect to the edge of the grinding wheel 34 (i.e. the arris between its cylindrical face and radial face 35).

The embodiments of the present invention are particularly, but not exclusively, suitable for use with the apparatus of FIG. 3. However it will be appreciated that such embodiments can be readily modified to suit almost any other arrangement comprising an abrasive wheel adjacent a support ledge for an implement to be sharpened. Other modifications and embodiments of the invention will similarly be readily apparent to those skilled in this art. For example, the predetermined "nib face to clearance face" angle may be other than 90°, e.g. 105°, and the abrasive wheel 34 provided with a frustoconical shape such as that of FIG. 3*a* having a radial surface inclined at said predetermined angle to a chamfered peripheral surface 134 — the radial surface serving to sharpen the nib faces 7, and the peripheral surface serving to sharpen the main clearance faces 6.

Where the said predetermined "nib face to clearance face" angle exceeds 90°, it may be that the two main clearance faces 6 need not be raked backwards at the predetermined rake angle ($\delta$) to the opposite sides of the drill bit, but may be at 90° or more to those sides. In any case, it may be arranged that the tip of the central nib 5 does not project forwardly of the radial plane through the most forward extremities of the main clearance faces 6.

Also, the present invention is not restricted to apparatus for sharpening "cylindrical" wood drill bits (such as those of FIG. 2), but may be readily modified to suit it for sharpening, either additionally or alternatively, "flat-bottomed" or "spade-like" wood drill bits (such as those of FIG. 1).

All such modifications and embodiments are to be deemed within the ambit and scope of the invention, and the invention is not to be deemed limited to the particular embodiment(s) hereinbefore described which may be varied in construction and detail without departing from the scope of the patent monopoly hereby sought.

I claim:

1. Sharpening apparatus for use in sharpening a wood drill bit that is held against rotation, the wood drill bit comprising a cutting end and a generally cylindrical shank leading thereto, the cutting end being formed with a forwardly directed central nib of generally triangular of pyramidal spike-like shape providing preliminary indenting side faces, and with a pair of main cutting edges at the forward ends of clearance faces oppositely inclined at a predetermined clearance angle to the radial plane perpendicular to the shank axis, the two clearance faces being disposed one to each side of the central nib and, in extending from the opposite sides of the drill towards the drill axis, are raked backwards at a predetermined rake angle to the opposite sides of the drill such as to be inclined to the respectively adjacent, axially inclined, preliminary indenting side face of the central nib at a predetermined "nib face to clearance fact" angle, said sharpening apparatus comprising:

an axially rotatable abrasive element having a peripheral abrasive surface and a lateral abrasive surface, support means for the wood drill bit, means to resist rotation of the wood drill bit during sharpening, and means for positioning the support means such that the wood drill bit supported thereby can engage the abrasive element with:

(a) said main clearance face in surfacial grinding engagement of the element's peripheral surface, the diametral plane of the abrasive element through the engagement location being inclined to the drill bit's shank axis at substantially the clearance angle of the clearance face, and simultaneously also with (b) said preliminary indenting face of the central nib in surfacial grinding engagement of the element's lateral surface.

2. Apparatus according to claim 1 wherein said lateral surface is radial.

3. Apparatus according to claim 1 wherein the support means compensates for different shank diameters of different drill bits by varying automatically the angle of inclination of such different shanks such that said clearance angle is maintained substantially constant for a range of the different drill bit shank diameters.

4. Apparatus according to claim 2 wherein said peripheral abrasive surface is a cylindrical surface at right-angles to the radial surface to suit the apparatus for sharpening a wood drill bit having a predetermined "nib face to clearance face" angle of 90°.

5. Apparatus according to claim 2 wherein the abrasive element has a frusto-conical peripheral surface at an angle, other than 90°, to said radial surface to suit the apparatus for sharpening a wood drill bit having a predetermined "nib face to clearance face" angle equal thereto.

6. Apparatus according to claim 3 wherein said support means provides first and second pairs of inclined support zones spaced apart to support a shank at at least two longitudinally spaced locations, wherein the pair of inclined support zones adjacent the abrasive element are mutually inclined at a first angle, and the pair of inclined support zones distal from the abrasive element are mutually inclined at a second angle, smaller than the said first angle.

7. Apparatus according to claim 1 wherein said positioning means comprises means to connect the support means to a part that is substantially immovable axially of the rotatable abrasive element.

8. Apparatus according to claim 1 wherein said positioning means is formed integrally with said support means to connect the support means to a part that is substantially immovable axially of the rotatable abrasive element.

9. Edge tool sharpening apparatus for the sharpening of an edge tool comprising a shank, said apparatus comprising:

an axially rotatable abrasive element having a peripheral abrasive surface, and support means comprising support surfaces to support the shank of the tool such that its face to be sharpened engages the abrasive surface with the shank axis at an acute angle to the diametral plane of the rotatable abrasive element through the engagement location, said support means providing for automatic compensation for different shank diameters of different drill bits, when supported by the same said support surfaces, by automatically effecting an increase in the inclination of said diametral plane with increase in the diameter of the shank and such that said acute angle is substantially constant for a range of the different drill bit shank diameters.

10. Edge tool sharpening apparatus according to claim 9 wherein said support surfaces provide first and second pairs of inclined support zones spaced apart to support a shank at at least two longitudinally spaced locations, the pair of inclined support zones adjacent the abrasive element are mutually inclined at a first angle, and the pair of inclined support zones distal from the abrasive element are mutually inclined at a second angle, smaller than said first angle.

11. Edge tool sharpening apparatus according to claim 10 wherein the inclined support zones are provided by the surfaces of a generally V-shaped channel.

12. Edge tool sharpening apparatus according to claim 9 comprising positioning means to connect the support means to a part that is substantially immovable axially of the rotatable abrasive element.

13. Edge tool sharpening apparatus according to claim 9 comprising positioning means formed integrally with said support means to connect the support means to a part that is substantially immovable axially of the rotatable abrasive element.

14. Sharpening apparatus according to claim 9 for sharpening a wood drill bit comprising a cutting end and a generally cylindrical shank leading thereto, the cutting end of the drill bit being formed with a forwardly directed central nib of one of generally triangular and pyramidal spike-like shape providing preliminary indenting side faces, and with a pair of main cutting edges at the forward ends of clearance faces oppositely inclined at a predetermined clearance angle to the radial plane perpendicular to the shank axis, the two clearance faces being disposed one to each side of the central nib and, in extending from the opposite sides of the drill towards the drill axis, being raked backwards at a predetermined rake angle to the opposite sides of the drill such as to be inclined to the respectively adjacent, axially inclined, preliminary indenting side face of the central nib at a predetermined "nib face to clearance face" angle, said sharpening apparatus having said acute angle substantially equal to the clearance angle of said clearance face.

15. Sharpening apparatus according to claim 14 wherein said acute angle is 15°.

16. Apparatus according to claim 6 wherein the inclined support zones are provided by the surfaces of a generally V-shaped channel.

* * * * *